US005394951A

United States Patent [19]

Pringle et al.

[11] Patent Number: 5,394,951

[45] Date of Patent: Mar. 7, 1995

[54] BOTTOM HOLE DRILLING ASSEMBLY

[75] Inventors: Ronald E. Pringle, Houston; Arthur J. Morris, Magnolia; Brian K. Moore, Humble, all of Tex.

[73] Assignee: Camco International Inc., Houston, Tex.

[21] Appl. No.: 166,245

[22] Filed: Dec. 13, 1993

[51] Int. Cl.[6] ..... E21B 7/08

[52] U.S. Cl. ..... 175/61; 175/26; 175/45; 175/74

[58] Field of Search ..... 175/26, 45, 61, 62, 175/74, 75, 107

[56] References Cited

U.S. PATENT DOCUMENTS

| | | | |
|---|---|---|---|
| 2,548,616 | 4/1951 | Priestman et al. . | |
| 3,225,843 | 12/1965 | Ortloff et al. . | |
| 3,872,932 | 3/1975 | Gosselin | 175/103 X |
| 4,067,404 | 1/1978 | Crase | 175/75 |
| 4,431,068 | 2/1984 | Dellinger et al. | 175/61 |
| 4,463,814 | 8/1984 | Horstmeyer et al. | 175/45 |
| 4,667,751 | 5/1987 | Ceczy et al. | 175/61 |
| 4,854,397 | 8/1989 | Warren et al. | 175/26 |
| 4,991,668 | 2/1991 | Rehm et al. | 175/61 |
| 5,186,264 | 2/1993 | Chaffaut | 175/27 |
| 5,215,151 | 6/1993 | Smith et al. | 175/45 |
| 5,220,963 | 6/1993 | Patton | 175/45 |
| 5,265,682 | 11/1993 | Russell et al. | 175/61 |
| 5,269,383 | 12/1993 | Forrest | 175/26 |
| 5,311,952 | 5/1994 | Eddison et al. | 175/61 |

OTHER PUBLICATIONS

Herben et al., "Coring to 50,000 feet with Coiled Tubing", Jan. 1991, ASME.

*Primary Examiner*—Ramon S. Britts
*Assistant Examiner*—Frank S. Tsay

[57] ABSTRACT

A bottom hole drilling assembly connectable to coiled tubing comprises a downhole motor to rotate a drill bit, articulated sub for causing the drill bit to drill a curved bore hole when a second portion thereof is bent from coaxial orientation with a first portion, steering tool for indicating the attitude of the bore hole, thruster for providing force to advance the drill bit, and orientating tool for rotating the thruster relative to the coiled tubing to control the path of the bore hole.

6 Claims, 1 Drawing Sheet

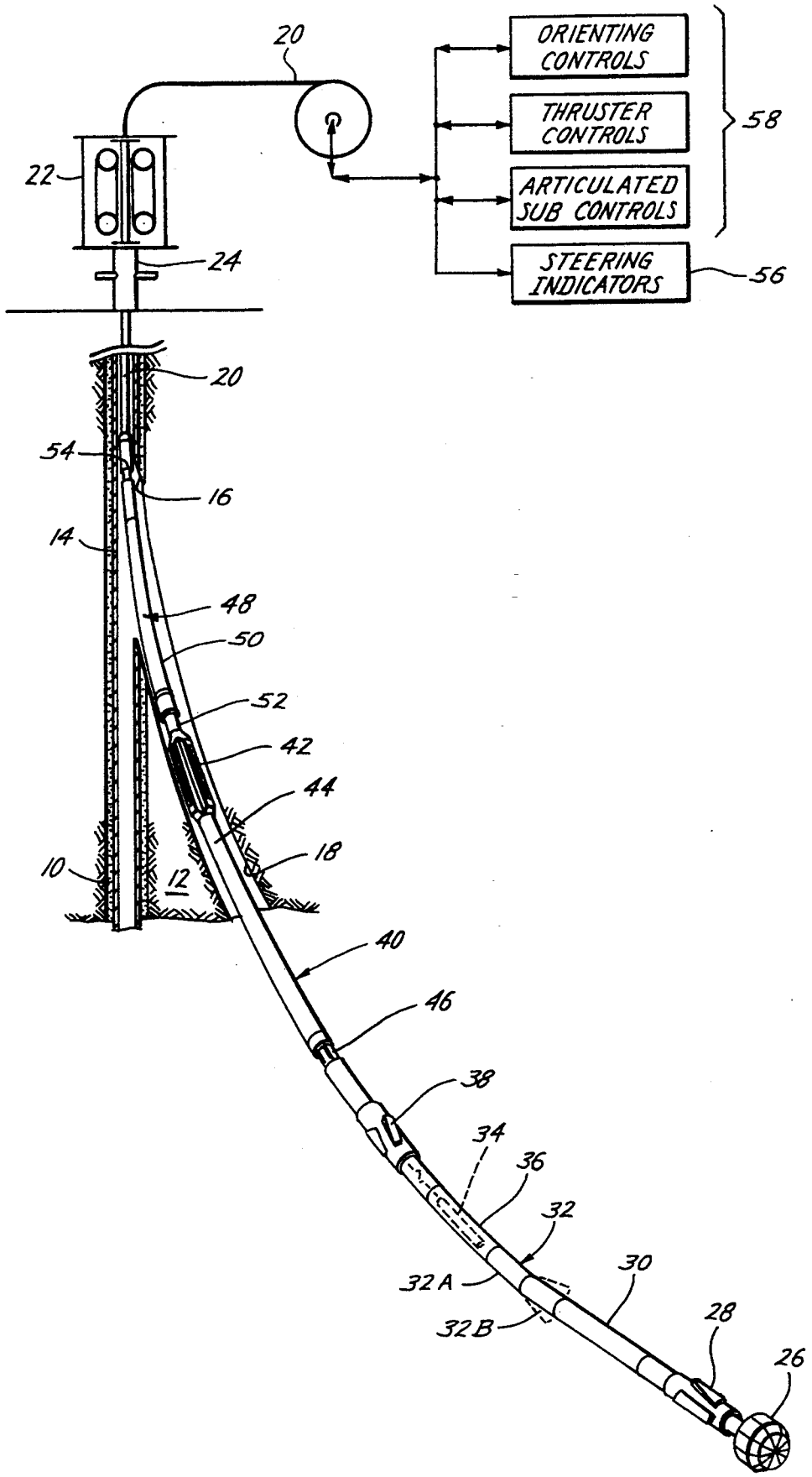
ORIENTING CONTROLS
THRUSTER CONTROLS
ARTICULATED SUB CONTROLS
STEERING INDICATORS
58
56
20
22
24
20
54
16
14
48
50
52
42
44
18
10
12
40
46
38
34
36
32
30
32 A
32 B
28
26

BOTTOM HOLE DRILLING ASSEMBLY

BACKGROUND OF THE INVENTION

1. Field of the Invention

The present invention relates to bottom hole drilling assemblies and, more particularly, to bottom hole drilling assemblies connectable to coiled tubing and used for directional drilling.

2. Description of Related Art

With the decline of oil production from existing wells in certain areas of the world, there has arisen in the oil production industry a recognition of the benefits of reentering existing wells and drilling lateral well bores out therefrom. These lateral well bores will, hopefully, increase the recovery rates and increase the quantity of oil recovered from these wells. Typically, these reentry drilling operations utilize downhole motors and electric steering tools to allow the drilling operator to properly guide or "steer" the path of the drill string as it creates the new, lateral well bore.

Several disadvantages of the above described reentry drilling operation have become apparent, and these include the relatively high cost of a workover rig, especially for offshore operations, and the need to drill "over pressure", i.e. to stop the flow of fluids from the subterranean formations while drilling. As has been found in re-entry drilling operations, such over pressuring can severally damage certain formations, which cause the quantity of oil recovered therefrom to sharply decrease.

In recent years the use of coiled tubing for drilling has increased due to the lower cost of a coiled tubing unit versus a conventional workover rig, and the ability of coiled tubing to drill while the well bore is "under pressured", i.e. the flow well bore fluids are not stopped while drilling. An example of a coiled tubing drilling unit and related methods of drilling with coiled tubing are described in U.S. Pat. No. 5,215,151, which is incorporated herein by reference.

Unfortunately, several disadvantages have become apparent in the use of the above described coiled tubing drilling operations. These disadvantages include: (i) the inability of the coiled tubing to be pushed from the earth's surface very far out into the formation before it buckles, and (ii) the inability of the coiled tubing to resist reactive torque of the downhole motor which can twist and kink the coiled tubing.

There is a need for a simple coiled tubing drilling assembly and related methods of use that can cost effectively drill a curved bore hole of any desired inclination and minimize bucking and twisting of the coiled tubing as the bore hole is extended laterally out from an existing well bore.

SUMMARY OF THE INVENTION

The present invention has been designed to overcome the foregoing deficiencies and meet the above described needs. Specifically, the present invention is a bottom hole drilling assembly for use in drilling a bore hole through the earth. The bottom hole drilling assembly of one preferred embodiment generally comprises: a downhole motor for rotating a drill bit; an articulated sub that causes the drill bit to drill a bore hole of desired inclination when one portion thereof is dislocated or bent from coaxial orientation with a second portion thereof; a steering tool for indicating the attitude of the bore hole; a thruster having a first portion for engaging a sidewall of the bore hole and having a second portion for providing force to advance the drill bit into the earth; and an orienting tool for rotating the articulated sub relative to a pipe string, such a length of coiled tubing, to control the path of the bore hole.

The articulated sub permits the sub to be inserted in a straight line or no inclination position and then be bent to the desired inclination while downhole, and the thruster applies the force necessary to advance the drill bit so the coiled tubing is not subject to buckling and twisting. Therefore, the heretofore unobtainable ability of drilling a lateral well bore of great length with coiled tubing can be achieved.

BRIEF DESCRIPTION OF THE DRAWING

The Drawing shows an elevational view of a bottom hole drilling assembly, of one preferred embodiment of the present invention, used for drilling a bore hole through the earth.

DETAILED DESCRIPTION OF THE PREFERRED EMBODIMENTS

As has been described above, the present invention is a bottom hole drilling assembly for use in drilling a bore hole through the earth, and in one preferred embodiment thereof, the present invention generally comprises an operative assembly of a downhole motor, an articulated sub, a steering tool, a thruster and an orienting tool. The present invention can be used to drill relatively straight, inclined or curved bore holes for water production, recovery of oil and gas, geothermal energy recovery, mining, tunneling, and any other purpose wherein a bore hole is needed to be created in the earth. For the purposes of this discussion, it will be assumed that the bore hole to be drilled using the present invention will be for the purpose of oil and gas recovery.

The bottom hole drilling assembly of the present invention can be used to drill original bore holes, extensions to existing well bores, well bore diameter enlarging, reaming operations, clean out and workover operations, and lateral extensions out from existing well bores. Further, the present invention can be used with rotary steerable drilling systems, percussion or downhole motor drilling systems. The present invention can be used with a conventional multi-sectioned drill string or with coiled tubing. For the purposes of the present discussion, it will be assumed that the bottom hole drilling assembly of one preferred embodiment of the present invention is connected to coiled tubing and is used to drill a lateral, curved bore hole out from an existing well bore.

One preferred embodiment of the present invention is shown in the attached Drawing wherein a well bore 10 extends from the earth's surface through at least one subterranean formation 12. The well bore 10 need not be cased and cemented, as shown in the Drawing, but if a subsurface pipe or casing 14 is provided then an opening 16 or "casing window" is cut or milled into the casing 14 to permit the sidetracking and extension of a lateral bore hole 18 by use of the bottom hole drilling assembly of the present invention. The tools and methods of creating such a casing window are commercially available and are well known to those skilled in the art.

Shown at the earth's surface are a commercially available reel of coiled tubing 20, a coiled tubing injector 22, and a wellhead and blow out preventor 24 attached to the upper end of the casing 14. The coiled tubing 20, the injector 22, and the well head 24 each can be of any commercially available configuration, as is well known to those skilled in the art.

In order to better explain the unique bottom hole drilling assembly of the present invention, reference will be made to each component shown in the Drawing, starting at the bottom of the bore hole 18 and working backwards to the earth's surface. While the discussion below indicates a particular sequence or order of these components, it should be understood that the Drawing shows just one preferred embodiment and that the components can be arranged in any order desired which will achieve the purposes of being able to drill a bore hole in the earth.

Starting at the bottom of the bore hole 18, a drill bit 26 is provided for the actual drilling or creating of the bore hole 18. Such drill bit 26 can be a roller cone, a PDC drag bit, or TSP diamond drag bit, as is well known to those skilled in the art. Connected to the drill bit 26 is a near bit centralizer or stabilizer 28, which can be of any commercially available configuration, for ensuring that the drill bit 26 remains in the center of the bore hole 18 as it is being created. In certain circumstances, such a stabilizer 28 is not needed, so its use is considered preferable but not essential. Connected to the stabilizer 28 is a downhole turbine or motor 30 which uses drilling fluid flowing from the earth's surface through the drill string or coiled tubing 20 to rotate the drill bit 26. Any commercially available configuration of downhole motor 30 can be used. If desired, downhole electric motors can be used to rotate the drill bit 26. Also, as described above, the use of such a downhole motor 30 is preferable but not essential, since in certain applications a surface rotary table or top drive (both not shown) can be used to rotate the drill bit 26.

An articulated sub 32 is connected to the downhole motor 30, and includes internal control mechanisms to permit its angle of deflection (shown in dotted lines) to be adjusted while at the earth's surface. While a conventional rigid bent sub, i.e. a tubular housing with a permanent bend with an angle of deflection therein, can be used with the present invention, it is preferable that an articulated sub 32 be used so that the path of the bore hole 18 can be easily adjusted after the bottom hole assembly has been run downhole. One particularly preferred articulated sub 32 is shown and described in commonly assigned U.S. patent application Ser. No. 061,953, filed May 17, 1993, which is herein incorporated by reference. The articulated sub 32 causes the drill bit 26 to drill a curved bore hole when a second position 32B is bent from coaxial alignment from a first position 32A. Internal mechanisms are included to permit the second position 32B to be deflected from O° to about 15° from coaxial alignment, as is desired. Extending out from the articulated sub 32 are one or more umbilicals or control lines (not shown) which pass within the drill string or coiled tubing 20 to the earth's surface, as is more fully described in U.S. patent application Ser. No. 061,953.

In order to inform the drilling operator at the earth's surface of the attitude, i.e. the path and disposition, of the bore hole 18, a commercially available electrical steering tool 34 is placed within the drill string or coiled tubing 20 and is landed therein adjacent the articulated sub 32. The steering tool 34 can be of any commercially available configuration, and for the purposes of this discussion it will be assumed to be an electric unit that passes periodic measurements in the form of representative signals of bore hole azimuth and inclination to the earth's surface. These signals can be produced by a magnetometer and by an inclinometer, as is well known to those skilled in the art. Commercially available mud pulse and/or electromagnetic measurement-while-drilling (MWD) equipment can be used in place of or in conjunction with the steering tool 34, as is desired by those skilled in the art.

To keep the bottom hole drilling assembly of the present invention generally centered within the bore hole 18, and to reduce the chances of bending the assembly, and to reduce abrasion and resulting drag, a centralizer or stabilizer 38 is connected to the housing 36. The centralizer 38 can be of any commercially available configuration, and can be of the same size and configuration or different, as desired, from the near bit centralizer 28.

One of the major advantages of the use of the above described assembly of the present invention when used with coiled tubing is the reduction in the risk of buckling and/or twisting of the coiled tubing. To accomplish this, force is applied not by way of the coiled tubing injector 22 but by way of a downhole thruster 40 connected to the centralizer 38. The thruster 40 includes at least one pad 42 that moves outwardly and engages the wall of the bore hole 18 to anchor one portion 44 of the thruster 40 while a second portion 46 thereof is free to move. This second portion 46 is forced by action of hydraulic, pneumatic, and/or electric power to extend a piston therein to advance the bottom hole assembly's components connected therebelow, and specifically the drill bit 26, into the earth.

Preferably the thruster shown and described in commonly assigned U.S. patent application Ser. No. 963,864, filed Oct. 20, 1992, is utilized. Once the second portion 46 of the thruster has been fully extended, the pads 42 are retracted and the whole bottom hole assembly is forced more fully into the bore hole 18 by its own weight and/or by the application of force from the earth's surface by the coiled tubing injector 22. Then, the pads 42 are extended again so that drilling can proceed in the above described "inch-worm" fashion. Other thrusters are shown in U.S. Pat. No. 3,225,843 and U.S. Pat. No. 5,186,264, which do not use dedicated power lines.

An orienting tool 48 to rotate the "tool face" is connected to the thruster 40 or it is preferably made part of the thruster 40, as is described and shown in the above noted commonly assigned U.S. patent application Ser. No. 963,864. Certain commercially available orienting tool can be utilized, as is well known by those skilled in the art, such as those shown in U.S. Pat. No. 4,286,676 and U.S. Pat. No. 5,215,151. The orienting tool 44 has a first portion 50 attached to the drill string or coiled tubing 20 while a second portion 52 is connected to the bottom hole assembly's components therebelow. Hydraulic, pneumatic and/or electric power is supplied from the earth's surface through dedicated control lines or umbilicals to cause the second portion 52 to rotate a desired number of degrees with respect to the relatively stationary first portion 50, thereby adjusting the orientation of the lower components and causing the rotating and advancing drill bit 26 to change its path.

In the event that coiled tubing 20 is utilized, an emergency disconnect device or coupling 54 is preferably included, but is not necessary, to permit the quick disconnection of the bottom hole assembly from the coiled tubing if any portion of the assembly becomes stuck within the bore hole 18. The emergency disconnect 54 permits the coiled tubing 20 to be removed so that "fishing", i.e. retrieval operations, can be initiated rather that having to leave the entire length of coiled tubing 20 in the bore hole when the assembly cannot be removed. Any commercially available disconnect can be utilized; however, the emergency disconnect shown and described in commonly assigned U.S. patent application Ser. No. 049,380, filed Apr. 21, 1993 is preferred.

As shown in the Drawing, dedicated power and control lines from the downhole components extend within the drill string or the coiled tubing 20 to the earth's surface, as is well known to those skilled in the art. The signals from the orienting tool 48, steering tool 34 and any other MWD systems utilized are routed to a visual indicator 56, such as one or more CRTs and/or one or more gauges, that provides the drilling operator with an understanding of the direction and inclination of the bore hole 18. Further, the control lines for the articulated sub 32, thruster 40, and the orienting tool 48 are likewise operatively connected, as is well known to those skilled in the art, to surface indicator and control equipment, generally indicated by reference numeral 58, so that the drilling operator can easily and accurately manipulate the various downhole controllable components.

To provide a better understanding of how the previously described components operate together as a system in one preferred embodiment of the present invention, the following discussion is provided. After the casing window has been cut, the bottom hole assembly is run downhole. When the drill bit 26 contacts the bottom of the lateral well bore 18, weight is applied to the coiled tubing 20 with additional pressure ("push") from the injector head 22, if necessary. The articulated bent sub 32 has been locked in a straight (no degrees of deflection) and rigid position by electrical current applied to an internal solenoid (not shown) through a dedicated power umbilical placed in the interior of the coiled tubing 20. Electrical current is then released to unlock internal mechanisms to allow the second portion 32B of the bent sub 32 to be moved and locked to a desired angle.

Hydraulic pressure is applied from the earth's surface through a power umbilical to extend the pads 42 out from the thruster unit. The pads 42 move outward contacting the open bore hole and locking the bottom hole assembly in place. At the same time, hydraulic pressure is applied to an internal piston in the thruster 40, which results in a downward force between the pads 42 and drill bit 26. This force is monitored, and adjusted at the earth's surface, from a load cell sub (not shown) that can be located between the thruster 40 and the drill bit 26. Also, an additional load cell sub (not shown) can be located in the top portion of the orienting tool 48 to monitor any buckling forces that might be applied to the coiled tubing 20.

Mud pumps (not shown) at the earth's surface force drilling fluids downwardly within the coiled tubing 20 to the motor 30. The motor 30 is operated by drilling fluids moving axially over an internal rotor/stator assembly and converting hydraulic energy into mechanical energy resulting in bit rotation with high torque. The reactive torque of the motor 30 is retained at the thruster's pads 42 which are in contact with the bore hole thereby preventing twisting of the coiled tubing 20 and upper sections of the bottom hole assembly. By the force of the thruster 40, the drill bit 26 is moved into the earth. As drilling continues, the operator at the earth's surface monitors azimuth and inclination of the borehole 18 from data received from the steering tool 34. If this data indicates that corrections are to be made, then the thruster 40 is deactivated, the pads 42 are retracted, and then the orienter tool 48 is rotated, as is desired. Then the orienter tool 48 is deactivated, the pads 42 are extended, and then the thruster 40 is activated.

This hydraulically and electrically operated bottom hole assembly is designed to have a fail safe mode, meaning a neutral position, in the event a malfunction occurs in any of the hydraulic or electrical components, which allows easy retrieval of the bottom hole assembly to the earth's surface. Further, in the event the bottom hole assembly becomes stuck in the bore hole 20 and is non-retrievable, an emergency disconnect coupling 54 is activated both hydraulically and electrically. Hydraulic disconnect is preferred and is accomplished by over pressuring the system through a predetermined rupture disc in the disconnect coupling 54. When the disc breaks, fluid pressure is allowed to move a disconnect piston from under locking dogs placed in its housing holding the coiled tubing 20 connected to the bottom hole assembly. The coiled tubing 20 can then be removed from the well bore 18. Thereafter, reentry of the well bore 200 with a specially designed hydraulic pulling tool can retrieve the bottom hole assembly.

Whereas the present invention has been described in particular relation to the Drawing attached hereto, it should be understood that other and further modifications, apart from those shown or suggested herein, may be made within the scope and spirit of the present invention.

What is claimed is:

1. A bottom hole assembly for use in drilling a bore hole through the earth, comprising:

motor means for rotating a drill bit;

articulated sub means for causing the drill bit to drill a curved bore hole, the articulated sub means comprises a body having a first portion connected to the motor means and a second portion connected to the first portion thereof in a manner to permit the second portion to be bent from coaxial orientation from the first portion;

thruster means connected to the articulated sub means for providing force to advance the drill bit;

orientation means for rotating the thruster means to control the path of the bore hole, the orientation means comprises a body having a first portion connected to a pipe string extending to the earth's surface and a second portion connected to the thruster means; and steering means inserted into the pipe string for indicating the attitude of the bore hole.

2. The bottom hole assembly of claim 1 wherein the articulated sub means includes internal control mechanisms controlled from the earth's surface for causing the second portion of the articulated sub means to be bent from coaxial orientation from the first portion of the articulated sub means with from 0 degrees to about 15 degrees of deflection.

3. The bottom hole assembly of claim 1 wherein the steering means comprises a magnetometer and an inclinometer which provide representative signals of the bore hole's radial orientation and inclination to the earth's surface.

4. The bottom hole assembly of claim 1 wherein the thruster means comprises a body having a first portion and a second portion, at least one sidewall engaging pad extending from the second portion of the thruster means, and hydraulic piston means within the first portion of the thruster means for extending the second portion of the thruster means with respect to the first portion of the thruster means.

5. A method of drilling a bore hole through the earth, comprising:

(a) providing a bottom hole assembly by connecting a drill bit to a motor, connecting an articulated sub to the motor, connecting a thruster unit to the articulated sub, connecting an orientation tool to the thruster unit, connecting a pipe string to the orientation unit, and providing a steering tool through the pipe string to a location adjacent the articulated sub;

(b) lowering the bottom hole assembly into a bore hole;

(c) providing fluid from the earth's surface through the pipe string to rotate the drill bit;

(d) extending a side wall engaging pad from the thruster unit, and causing the thruster unit to advance the rotating drill bit;

(e) determining the attitude of the bore hole from signals provided from the steering tool;

(f) comparing the attitude of the bore hole with a desired attitude of the bore hole, and if there is a variance, retracting the side wall engaging pad of the thruster unit, rotating the orientation tool relative to the pipe string, with the extent of rotation selected to cause the drill bit to create a bore hole that converges with the desired attitude of the bore hole; and (e) causing the thruster unit to advance the rotating drill bit.

6. The method of claim 5 and further comprising changing the deflection of the articulated sub to cause the drill bit to create a bore hole that converges with the desired attitude of the bore hole.

* * * * *